United States Patent [19]

Hostetler

[11] Patent Number: 4,643,341

[45] Date of Patent: Feb. 17, 1987

[54] SEWING THIMBLE

[76] Inventor: Ruby M. Hostetler, P.O. Box 113, Walnut Creek, Ohio 44687

[21] Appl. No.: 872,265

[22] Filed: Jun. 9, 1986

[51] Int. Cl.[4] ..... D05B 91/04

[52] U.S. Cl. ..... 223/101; 223/109 R; 66/1 A

[58] Field of Search ..... 223/101, 109; 66/1 R, 66/1 A

[56] References Cited

U.S. PATENT DOCUMENTS

| | | | |
|---|---|---|---|
| D. 194,257 | 12/1962 | Burbig | D3/29 |
| 743,280 | 11/1903 | Hemenway | 223/101 |
| 1,473,953 | 11/1923 | Dart | 223/101 |
| 1,620,996 | 3/1927 | Caulkins | 223/101 |
| 2,415,957 | 2/1947 | McCormack | D3/29 |
| 2,475,324 | 7/1949 | Jaske | 223/109 |
| 2,589,499 | 3/1952 | Lake | 223/101 |
| 2,704,889 | 3/1955 | Delinanos | 223/101 |
| 4,102,979 | 7/1978 | Braley | 223/101 |

FOREIGN PATENT DOCUMENTS

| | | | |
|---|---|---|---|
| 0124148 | 11/1984 | European Pat. Off. | 223/101 |

*Primary Examiner*—Werner H. Schroeder
*Assistant Examiner*—Mary A. Ellis
*Attorney, Agent, or Firm*—Mack D. Cook, II

[57] ABSTRACT

A sewing thimble having an inner barrel, a blade segment and an outer shell. The molded inner shell is semi-rigid and has a projecting lug for positioning the cutting edge of the blade segment. The outer shell is resilient or slightly deformable and is molded around and encases the inner barrel. The outer shell has a laterally projecting and thickened bulb area which covers the inner barrel lug beneath the cutting edge of the blade segment. A flap cut is formed in the bulb area to provide a means so that a user may grip and pull a needle and thread by thumb pressure applied against the bulb area.

3 Claims, 7 Drawing Figures

FIG. 1
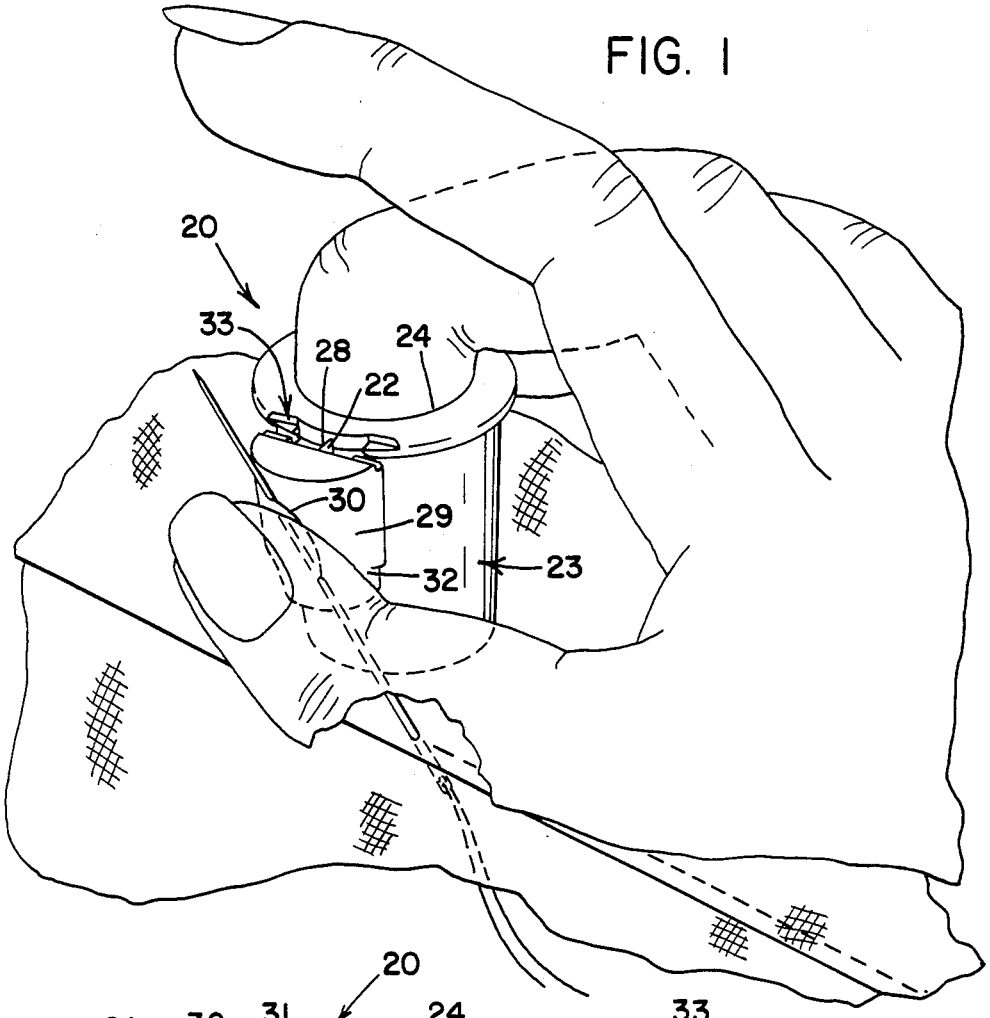
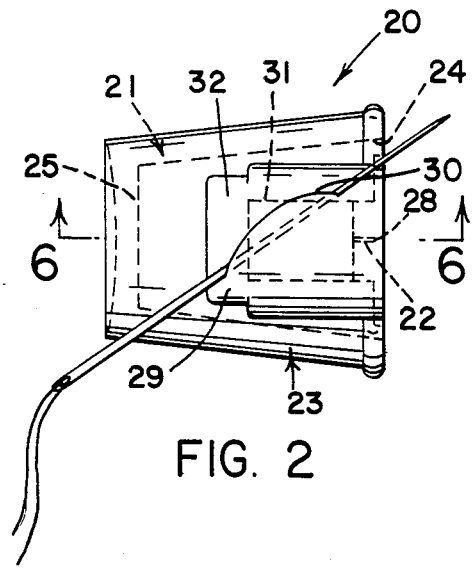
FIG. 2
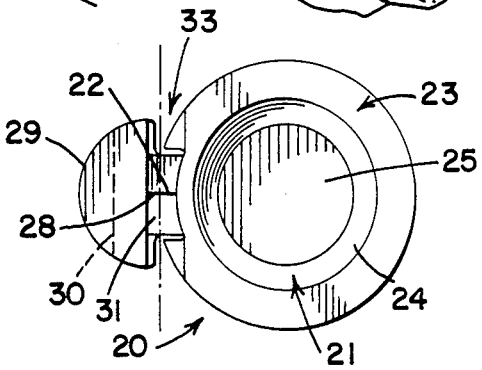
FIG. 3

SEWING THIMBLE

BACKGROUND OF THE INVENTION

The present invention relates to a thimble for use with a needle and thread in hand sewing. The invention was made to provide a sewing thimble with multiple functions: pushing a needle through buttons or heavy cloth, pulling a needle and thread through heavy cloth or when stuck, and cutting the thread when finished sewing. The improved sewing thimble is a composite structure precision molded from state of the art plastic compounds so as to have a long useful life.

The scope and content of the prior art has been determined as explained below.

U.S. Pat. No. 743,280, November, 1903, Hemenway discloses a thimble carrying a ring 4 with elliptical openings 8. The thimble wall has a needle groove 3. A needle 11 is gripped against the groove 3 by a push-button 5 with a serrated face.

U.S. Pat. No. 1,620,996, March 1927, Caulkins discloses a needle pulling thimble with a pair of spaced rigid lugs 20 and 22 having oppositely bevelled parallel lips 21 and 23 next to open end rim 12.

U.S. Pat. No. 2,475,324, July, 1949, Jaske discloses a thimble with a closed end and side slot 14 so that a thread may be cut by an insert disk 9.

U.S. Pat. No. 2,589,499, March, 1952, Lake discloses a thimble with a needle-gripping block formed by a transverse tube 3 and a resilient blade 4. A separate cup-shaped finger shield 6 may be secured in the thimble inwardly of the tube B to protect the finger of the wearer from contact with the tube 3. In another form, the needle is positioned within a transverse block 8 and engaged by a thumb pressure actuated jaw or block 10.

U.S. Pat. No. Des. 194,257, December, 1962, Burbig shows a thimble with a side mounted needle pulling element looking somewhat like an aircraft jet engine.

SUMMARY OF THE INVENTION

It is an object of the present invention to provide an improved sewing thimble with multiple functions: pushing a needle, pulling a needle and thread, and cutting the thread.

It is a further object to provide an improved sewing thimble precision molded from state of the art plastic compounds so as to have a long useful life.

These and other objects of the invention and further advantages thereof, will be apparent in view of the detailed description and drawings.

In general, the improved thimble comprises an inner barrel, a blade segment and an other shell.

The inner barrel has an open upper end to receive the finger of a user, a closed lower end, and a laterally projecting lug beneath the upper end and having a vertically oriented notch therein.

The blade segment is positioned within the inner barrel lug notch and has a thread cutting edge extending laterally beneath the barrel upper end.

The outer shell is molded around and encases the inner barrel. The outer shell has a laterally projecting and thickened bulb area covering the inner barrel lug beneath the blade segment cutting edge and extending down the side of the thimble. The bulb area has a width such that a flap cut may be made therein. The flap cut provides a means so that a user may grip and pull a needle and thread by thumb pressure applied against the bulb area.

IN THE DRAWINGS

FIG. 1 is a view illustrating the use of a thimble according to the invention to pull a needle and thread through heavy cloth;

FIG. 2 is a side view of a thimble for use by a right handed person;

FIG. 3 is a top view of a thimble;

DETAILED DESCRIPTION OF THE INVENTION

Figure 4:
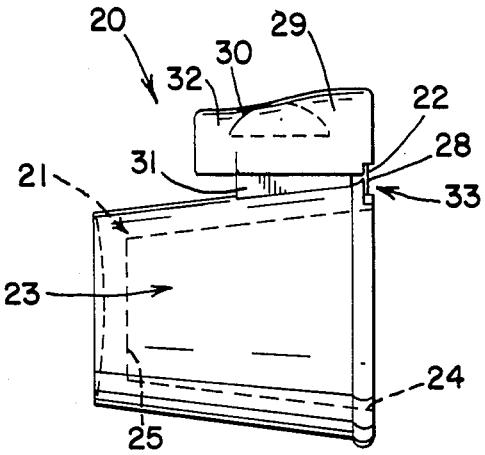
FIG. 4 is a side view of a thimble.
Figure 5:
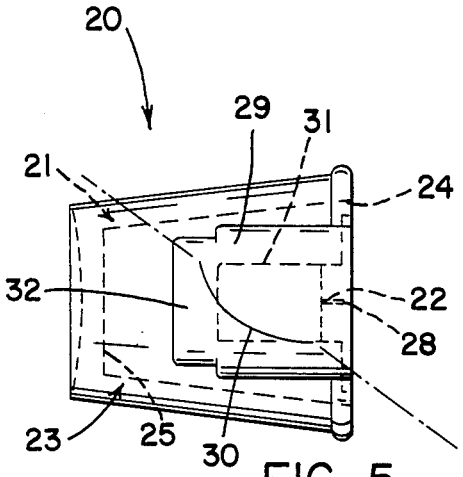
FIG. 5 is a view similar to FIG. 2 showing a thimble for use by a left handed person.
Figure 6:
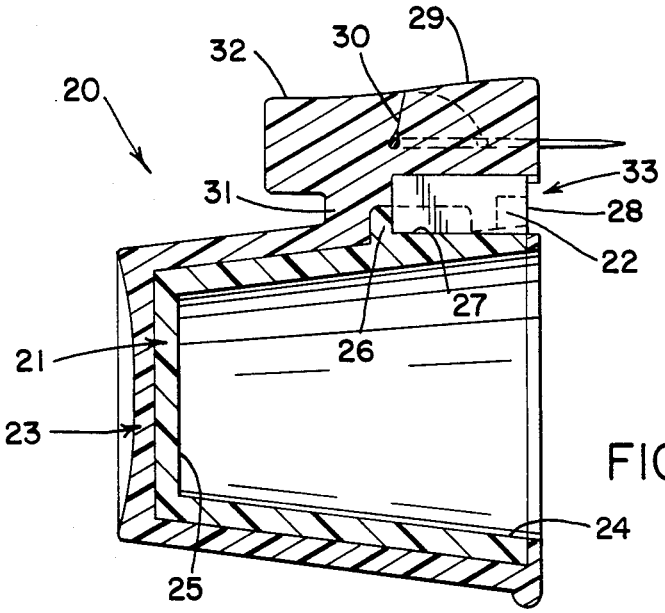
FIG. 6 is an enlarged view in section taken substantially as indicated on line 6—6 of FIG. 2.
Figure 7:
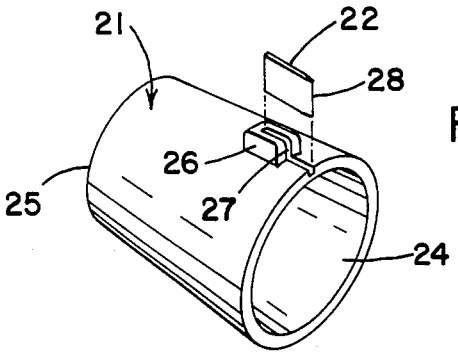
FIG. 7 is a view in perspective of the inner shell and blade segment of a thimble.

An improved sewing thimble according to the invention is referred to generally by the numeral 20. A thimble 20 has a semi-rigid inner barrel 21, a blade segment 22 and a resilient outer shell 23.

An inner barrel 21 has a tapered cylindrical shape with an open upper end 24 to receive the finger of a user. The lower end 25 of a barrel 21 is closed to provide a support surface for pushing a sewing needle. A barrel 21 has an integral and laterally projecting lug 26 beneath the upper end 24. The lug 26 has a vertically oriented notch 27 therein.

A blade segment 22 is securely held by and positioned within the inner barrel lug notch 27. A blade segment 22 has a thread cutting edge 28 extending laterally beneath the barrel upper end 24.

An outer shell 23 is molded around and encases an inner barrel 21. An outer shell 23 has a laterally projecting and thickened bulb area 29 covering the inner barrel lug 26 and extending down the side of a thimble 20. The bulb area 29 has a width such that a flap cut 30 may be made therein. The flap cut 30 provides a means so that a user may grip and pull a needle and thread by thumb pressure applied against the bulb area 29.

The bulb area 29 preferably has a shorter radially inner base portion 31 covering the inner barrel lug 26. The base portion 31 carries thereon a radially outer longer bar portion 32 with overhanging upper and lower ends. The lower end of the bar portion 32 facilitates manual deformation of the bulb area 29 to open the flap cut 30 to position a needle therein. The open space between the upper end of the bar portion 32 and above the inner barrel lug 26 provides a guide slot indicated at 33 to easily position a thread for cutting by the blade segment edge 28 and to protect the thumb or finger of the user from being accidentally cut by the edge 28.

An inner barrel 21 can be made by a conventional injection molding process using a suitable state of the art plastic. An inner barrel 21 is molded to be semi-rigid and should have a durometer A value of 90/80.

After insertion of a blade segment 22 into the lug notch 27 of a molded inner barrel 21, the barrel 21 may be used as the plug in a conventional insert molding process using a suitable state of the art plastic to make the outer shell 23. The outer shell 23 is molded to be resilient and slightly deformable and should have a durometer A value of 65/60.

What is claimed is:

1. A thimble for use with a needle and thread in hand sewing, said thimble comprising:

an inner barrel having an open upper end to receive the finger of a user, a closed lower end and a laterally projecting lug beneath said upper end and having a vertically oriented notch therein;

a blade segment positioned within said lug notch and having a thread cutting edge extending laterally beneath said inner barrel upper end; and, an outer shell molded around and encasing said inner barrel, said outer shell having a laterally projecting and thickened bulb area covering said inner barrel lug beneath said blade segment cutting edge and extending down the side of said thimble, said bulb area having a width such that a flap cut may be formed therein, said flap cut providing a means so that a user may grip and pull a needle and thread by thumb pressure applied against said bulb area.

2. A thimble according to claim 1 wherein said outer shell bulb area has a shorter inner base portion carrying thereon an outer longer bar portion with an overhanging lower end, said lower end facilitating manual deformation of said bulb area to open said flap cut to position a needle therein.

3. A thimble according to claim 1 wherein said bulb area outer longer bar portion also has an overhanging upper end, the open space between said upper end and above said inner barrel lug providing a guide slot to easily position a thread for cutting by said blade segment edge.

* * * * *